US009983506B2

(12) United States Patent
Carpenter et al.

(10) Patent No.: US 9,983,506 B2
(45) Date of Patent: May 29, 2018

(54) REPLACEABLE UNIT FOR AN IMAGE FORMING DEVICE HAVING MAGNETS OF VARYING ANGULAR OFFSET FOR TONER LEVEL SENSING

(71) Applicant: LEXMARK INTERNATIONAL, INC., Lexington, KY (US)

(72) Inventors: Brian Scott Carpenter, Lexington, KY (US); Michael Craig Leemhuis, Nicholasville, KY (US); Robert Watson McAlpine, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 10 days.

(21) Appl. No.: 15/341,216

(22) Filed: Nov. 2, 2016

(65) Prior Publication Data

US 2017/0052478 A1 Feb. 23, 2017

Related U.S. Application Data

(63) Continuation of application No. 14/953,714, filed on Nov. 30, 2015, now Pat. No. 9,519,243, which is a continuation-in-part of application No. 14/556,464, filed on Dec. 1, 2014, now Pat. No. 9,389,582.

(60) Provisional application No. 62/006,291, filed on Jun. 2, 2014.

(51) Int. Cl.

| | |
|---|---|
| ***G03G 15/08*** | (2006.01) |
| ***G03G 15/09*** | (2006.01) |
| ***G03G 21/18*** | (2006.01) |

(52) U.S. Cl.

CPC ..... *G03G 15/0831* (2013.01); *G03G 15/086* (2013.01); *G03G 15/087* (2013.01); *G03G 15/0889* (2013.01); *G03G 15/0921* (2013.01); *G03G 21/1803* (2013.01)

(58) Field of Classification Search

CPC ..... G03G 15/0831; G03G 15/0889; G03G 15/087; G03G 21/1803; G03G 15/086; G03G 15/0921

USPC ..... 399/27, 61, 254

See application file for complete search history.

(56) References Cited

FOREIGN PATENT DOCUMENTS

| | | |
|---|---|---|
| JP | H05-046026 A | 2/1993 |
| JP | 2002-132036 A | 5/2002 |

OTHER PUBLICATIONS

JPO Machine translation of JP H05-046026A.
JPO Machine translation of JP 2002-132036A.
English translation of Office Action dated Dec. 18, 2017 for Colombia Patent Application No. NC2016/0004906.

*Primary Examiner* — Walter L Lindsay, Jr.
*Assistant Examiner* — Ruth Labombard
(74) *Attorney, Agent, or Firm* — Justin M. Tromp

(57) ABSTRACT

A replaceable unit for an electrophotographic image forming device according to one example embodiment includes a housing having a reservoir for storing toner. A rotatable shaft is positioned within the reservoir and has an axis of rotation. A first magnet and a second magnet are connected to the shaft and rotatable around the axis of rotation in response to rotation of the shaft. The first magnet and the second magnet are detectable by a magnetic sensor when the replaceable unit is installed in the image forming device. A polarity of the first magnet is oriented opposite a polarity of the second magnet relative to the shaft. An amount of angular offset between the first magnet and the second magnet varies depending on an amount of toner in the reservoir.

18 Claims, 12 Drawing Sheets

REPLACEABLE UNIT FOR AN IMAGE FORMING DEVICE HAVING MAGNETS OF VARYING ANGULAR OFFSET FOR TONER LEVEL SENSING

CROSS REFERENCES TO RELATED APPLICATIONS

This patent application is a continuation application of U.S. patent application Ser. No. 14/953,714, filed Nov. 30, 2015, entitled "Replaceable Unit for an Image Forming Device Having Magnets of Varying Angular Offset for Toner Level Sensing," which is a continuation-in-part application of U.S. patent application Ser. No. 14/556,464, filed Dec. 1, 2014, now U.S. Pat. No. 9,389,582, issued Jul. 12, 2016, entitled "Replaceable Unit for an Image Forming Device Having Magnets of Varying Angular Offset for Toner Level Sensing," which claims priority to U.S. Provisional Patent Application Ser. No. 62/006,291, filed Jun. 2, 2014, entitled "Replaceable Unit for an Image Forming Device Having a Paddle for Toner Level Sensing," the contents of which are hereby incorporated by reference in their entirety.

BACKGROUND

1. Field of the Disclosure

The present disclosure relates generally to image forming devices and more particularly to a replaceable unit for an image forming device having magnets of varying angular offset for toner level sensing.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the drum. The toned image is transferred to the print media (e.g., paper) either directly by the photoconductive drum or indirectly by an intermediate transfer member. The toner is then fused to the media using heat and pressure to complete the print.

The image forming device's toner supply is typically stored in one or more replaceable units installed in the image forming device. As these replaceable units run out of toner, the units must be replaced or refilled in order to continue printing. As a result, it is desired to measure the amount of toner remaining in these units in order to warn the user that one of the replaceable units is near an empty state or to prevent printing after one of the units is empty in order to prevent damage to the image forming device. Accordingly, a system for measuring the amount of toner remaining in a replaceable unit of an image forming device is desired.

SUMMARY

A replaceable unit for an electrophotographic image forming device according to one example embodiment includes a housing having a reservoir for storing toner. A rotatable shaft is positioned within the reservoir and has an axis of rotation. A first magnet and a second magnet are connected to the shaft and rotatable around the axis of rotation in response to rotation of the shaft. The first magnet and the second magnet are detectable by a magnetic sensor when the replaceable unit is installed in the image forming device. A polarity of the first magnet is oriented opposite a polarity of the second magnet relative to the shaft. An amount of angular offset between the first magnet and the second magnet varies depending on an amount of toner in the reservoir.

Embodiments include those wherein one of a north pole and a south pole of the first magnet is directed outward away from the shaft and the other of a north pole and a south pole of the second magnet is directed outward away from the shaft.

In some embodiments, the first magnet is substantially axially aligned with the second magnet with respect to the axis of rotation. In some embodiments, the first magnet is substantially radially aligned with the second magnet with respect to the axis of rotation.

Embodiments include those wherein a first linkage is rotatable with the shaft and rotatable independent of the shaft between a forward rotational stop and a rearward rotational stop. The second magnet is mounted on the first linkage. In some embodiments, a second linkage is fixed to rotate with the shaft and the first magnet is mounted on the second linkage. In some embodiments, the first linkage has a paddle member leading the first magnet in an operative rotational direction of the shaft and the second magnet trails the first magnet in the operative rotational direction of the shaft. The paddle member may include a third magnet. In some embodiments, the first linkage is biased by a biasing member in an operative rotational direction of the shaft toward the forward rotational stop.

A replaceable unit for an electrophotographic image forming device according to a second example embodiment includes a housing having a reservoir for storing toner. A rotatable shaft is positioned within the reservoir and has an axis of rotation. A first magnet and a second magnet are connected to the shaft and rotatable around the axis of rotation in response to rotation of the shaft. The first magnet and the second magnet pass near at least a portion of an inner wall of the housing forming the reservoir during rotation of the first and second magnets. A first pole of the first magnet is directed outward away from the shaft and a second pole of the second magnet is directed outward away from the shaft. A polarity of the first pole is opposite a polarity of the second pole. An amount of angular offset between the first magnet and the second magnet varies depending on an amount of toner in the reservoir.

A replaceable unit for an electrophotographic image forming device according to a third example embodiment includes a housing having a reservoir for storing toner. A rotatable shaft is positioned within the reservoir and has an axis of rotation. A first magnet, a second magnet and a third magnet are connected to the shaft and rotatable around the axis of rotation in response to rotation of the shaft. The first magnet, the second magnet and the third magnet pass near at least a portion of an inner wall of the housing forming the reservoir during rotation of the first, second and third magnets. The second magnet leads the first magnet in an operative rotational direction of the shaft and the third magnet trails the first magnet in the operative rotational direction of the shaft. An amount of angular offset between the first magnet and the second magnet and an amount of angular offset between the first magnet and the third magnet vary depending on an amount of toner in the reservoir.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
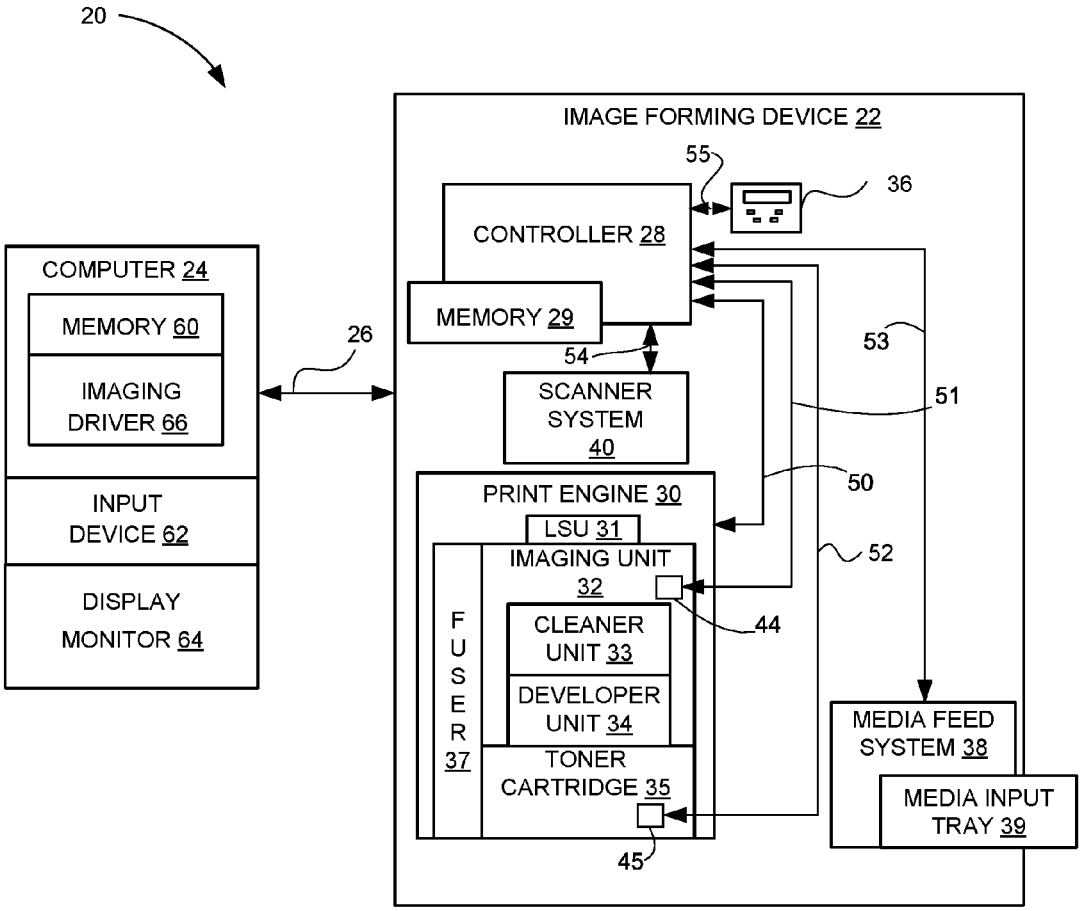
FIG. 1 is a block diagram of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 32, a toner cartridge 35, a user interface 36, a media feed system 38, a media input tray 39 and a scanner system 40. Image forming device 22 may communicate with computer 24 via a standard communication protocol, such as for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated memory 29. The processor may include one or more integrated circuits in the form of a microprocessor or central processing unit and may be formed as one or more Application-specific integrated circuits (ASICs). Memory 29 may be any volatile or non-volatile memory of combination thereof such as, for example, random access memory (RAM), read only memory (ROM), flash memory and/or non-volatile RAM (NVRAM). Alternatively, memory 29 may be in the form of a separate electronic memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 45 thereon via a communications link 52. Controller 28 communicates with media feed system 38 via a communications link 53. Controller 28 communicates with scanner system 40 via a communications link 54. User interface 36 is communicatively coupled to controller 28 via a communications link 55. Processing circuitry 44, 45 may provide authentication functions, safety and operational interlocks, operating parameters and usage information related to imaging unit 32 and toner cartridge 35, respectively. Controller 28 processes print and scan data and operates print engine 30 during printing and scanner system 40 during scanning.

Computer 24, which is optional, may be, for example, a personal computer, including memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 35, imaging unit 32, and a fuser 37, all mounted within image forming device 22. Imaging unit 32 is removably mounted in image forming device 22 and includes a developer unit 34 that houses a toner sump and a toner delivery system. In one embodiment, the toner delivery system utilizes what is commonly referred to as a single component development system. In this embodiment, the toner delivery system includes a toner adder roll that provides toner from the toner sump to a developer roll. A doctor blade provides a metered uniform layer of toner on the surface of the developer roll. In another embodiment, the toner delivery system utilizes what is commonly referred to as a dual component development system. In this embodiment, toner in the toner sump of developer unit 34 is mixed with magnetic carrier beads. The magnetic carrier beads may be coated with a polymeric film to provide triboelectric properties to attract toner to the carrier beads as the toner and the magnetic carrier beads are mixed in the toner sump. In this embodiment, developer unit 34 includes a magnetic roll that attracts the magnetic carrier beads having toner thereon to the magnetic roll through the use of magnetic fields.

Imaging unit 32 also includes a cleaner unit 33 that houses a photoconductive drum and a waste toner removal system. Toner cartridge 35 is removably mounted in imaging forming device 22 in a mating relationship with developer unit 34 of imaging unit 32. An outlet port on toner cartridge 35 communicates with an entrance port on developer unit 34 allowing toner to be periodically transferred from toner cartridge 35 to resupply the toner sump in developer unit 34.

The electrophotographic printing process is well known in the art and, therefore, is described briefly herein. During a printing operation, laser scan unit 31 creates a latent image on the photoconductive drum in cleaner unit 33. Toner is transferred from the toner sump in developer unit 34 to the latent image on the photoconductive drum by the developer roll (in the case of a single component development system) or by the magnetic roll (in the case of a dual component development system) to create a toned image. The toned image is then transferred to a media sheet received by imaging unit 32 from media input tray 39 for printing. Toner may be transferred directly to the media sheet by the photoconductive drum or by an intermediate transfer member that receives the toner from the photoconductive drum. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
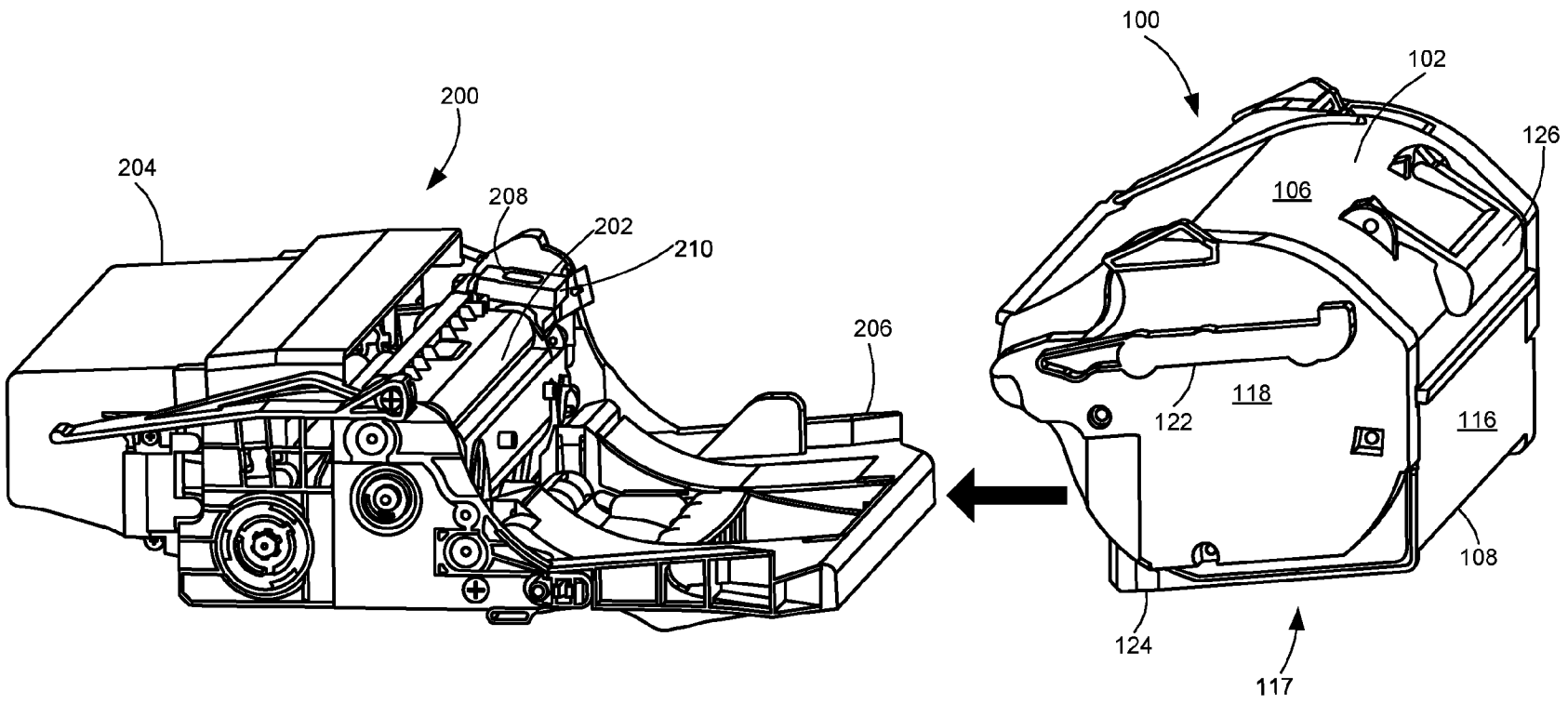
FIG. 2 is a perspective view of a toner cartridge and an imaging unit according to one example embodiment.
Figure 3:
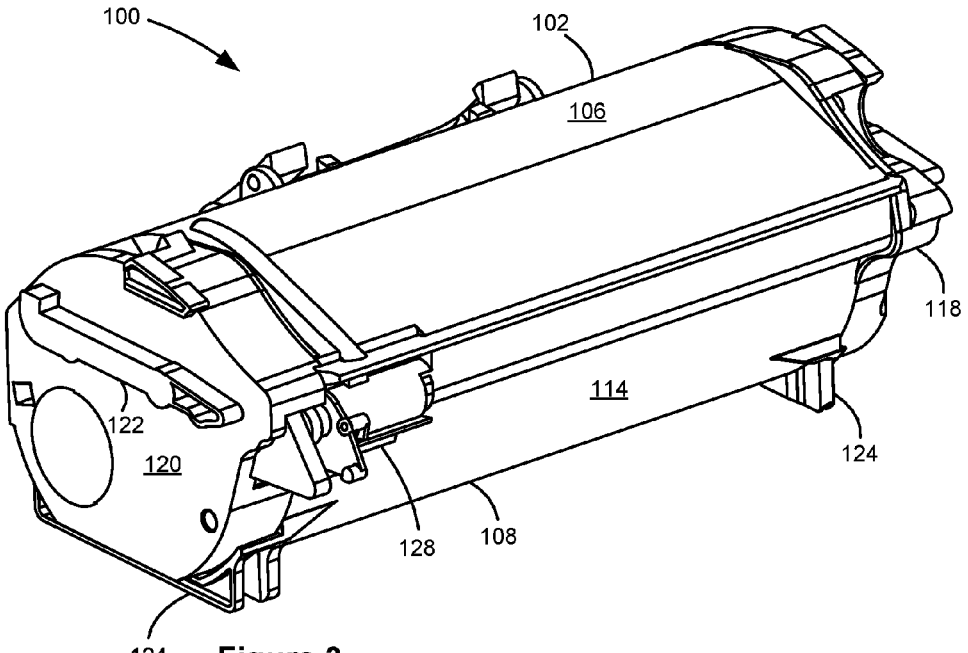
FIGS. 3 and 4 are additional perspective views of the toner cartridge shown in FIG. 2.
Figure 4:
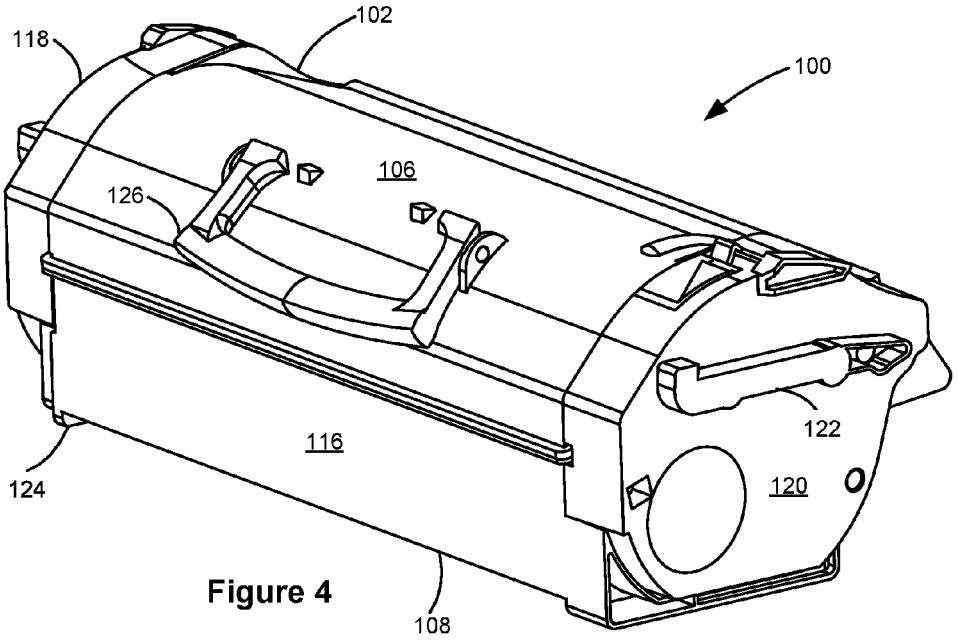

Referring now to FIG. 2, a toner cartridge 100 and an imaging unit 200 are shown according to one example embodiment. Imaging unit 200 includes a developer unit 202 and a cleaner unit 204 mounted on a common frame 206. As discussed above, imaging unit 200 and toner cartridge 100 are each removably installed in image forming device 22. Imaging unit 200 is first slidably inserted into image forming device 22. Toner cartridge 100 is then inserted into image forming device 22 and onto frame 206 in a mating relationship with developer unit 202 of imaging unit 200 as indicated by the arrow shown in FIG. 2. This arrangement allows toner cartridge 100 to be removed and reinserted easily when replacing an empty toner cartridge 100 without having to remove imaging unit 200. Imaging unit 200 may also be readily removed as desired in order to maintain, repair or replace the components associated with developer unit 202, cleaner unit 204 or frame 206 or to clear a media jam.

With reference to FIGS. 2-5, toner cartridge 100 includes a housing 102 having an enclosed reservoir 104 (FIG. 5) for storing toner. Housing 102 may include a top or lid 106 mounted on a base 108. Base 108 includes first and second side walls 110, 112 connected to adjoining front and rear walls 114, 116 and a bottom 117. In one embodiment, top 106 is ultrasonically welded to base 108 thereby forming enclosed reservoir 104. First and second end caps 118, 120 may be mounted to side walls 110, 112, respectively, and may include guides 122 to assist the insertion of toner cartridge 100 into image forming device 22 for mating with developer unit 202. First and second end caps 118, 120 may be snap fitted into place or attached by screws or other fasteners. Guides 122 travel in corresponding channels within image forming device 22. Legs 124 may also be provided on bottom 117 of base 106 or end caps 118, 120 to assist with the insertion of toner cartridge 100 into image forming device 22. Legs 124 are received by frame 206 to facilitate the mating of toner cartridge 100 with developer unit 202. A handle 126 may be provided on top 106 or base 108 of toner cartridge 100 to assist with insertion and removal of toner cartridge 100 from imaging unit 200 and image forming device 22. An outlet port 128 is positioned on front wall 114 of toner cartridge 100 for exiting toner from toner cartridge 100.

Figure 5:
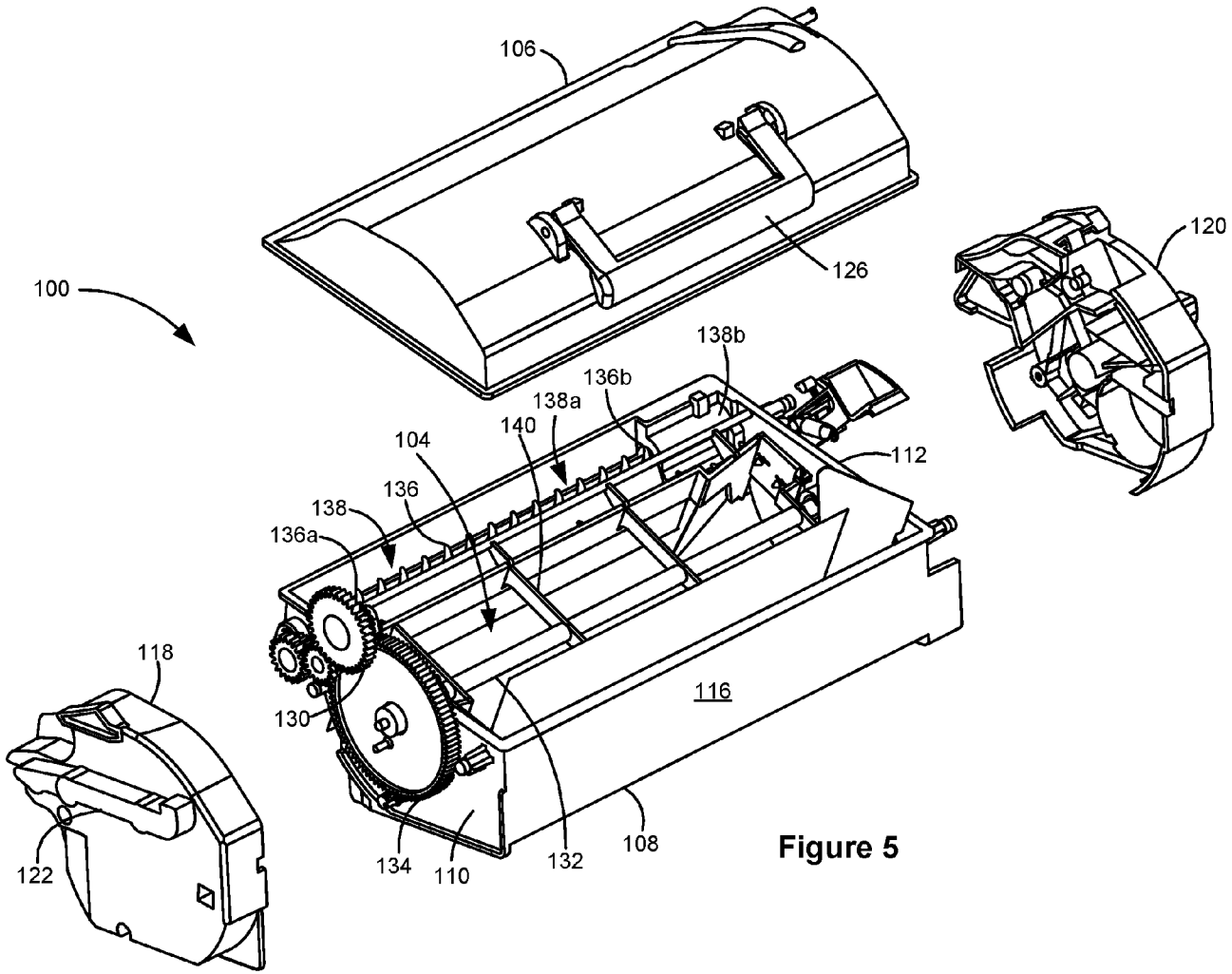
FIG. 5 is an exploded view of the toner cartridge shown in FIG. 2 showing a reservoir for holding toner therein.

With reference to FIG. 5, various drive gears are housed within a space formed between end cap 118 and side wall 110. A main interface gear 130 engages with a drive system in image forming device 22 that provides torque to main interface gear 130. A paddle assembly 140 is rotatably mounted within toner reservoir 104 with first and second ends of a drive shaft 132 of paddle assembly 140 extending through aligned openings in side walls 110, 112, respectively. A drive gear 134 is provided on the first end of drive shaft 132 that engages with main interface gear 130 either directly or via one or more intermediate gears. Bushings may be provided on each end of drive shaft 132 where it passes through side walls 110, 112.

An auger 136 having first and second ends **136*a*, 136*b* and a spiral screw flight is positioned in a channel 138 extending along the width of front wall 114 between side walls 110, 112. Channel 138 may be integrally molded as part of front wall 114 or formed as a separate component that is attached to front wall 114. Channel 138 is generally horizontal in orientation along with toner cartridge 100 when toner cartridge 100 is installed in image forming device 22. First end 136*a* of auger 136 extends through side wall 110 and a drive gear (not shown) is provided on first end 136*a* that engages with main interface gear 130 either directly or via one or more intermediate gears. Channel 138 may include an open portion 138*a* and an enclosed portion 138*b*. Open portion 138*a* is open to toner reservoir 104 and extends from side wall 110 toward second end 136*b* of auger 136. Enclosed portion 138*b* of channel 138 extends from side wall 112 and encloses an optional shutter and second end 136*b* of auger 136. In this embodiment, outlet port 128 is positioned at the bottom of enclosed portion 138*b* of channel 138 so that gravity will assist in exiting toner through outlet port 128. The shutter is movable between a closed position blocking toner from exiting outlet port 128 and an open position permitting toner to exit outlet port 128**.

As paddle assembly 140 rotates, it delivers toner from toner reservoir 104 into open portion **138*a* of channel 138. As auger 136 rotates, it delivers toner received in channel 138 into enclosed portion 138*b* of channel 138 where the toner passes out of outlet port 128 into a corresponding entrance port 208 in developer unit 202 (FIG. 2). In one embodiment, entrance port 208 of developer unit 202 is surrounded by a foam seal 210 that traps residual toner and prevents toner leakage at the interface between outlet port 128 and entrance port 208**.

The drive system in image forming device 22 includes a drive motor and a drive transmission from the drive motor to a drive gear that mates with main interface gear 130 when toner cartridge 100 is installed in image forming device 22. The drive system in image forming device 22 may include an encoded device, such as an encoder wheel, (e.g., coupled to a shaft of the drive motor) and an associated code reader, such as an infrared sensor, to sense the motion of the encoded device. The code reader is in communication with controller 28 in order to permit controller 28 to track the amount of rotation of main interface gear 130, auger 136 and paddle assembly 140.

Although the example embodiment shown in FIGS. 2-5 includes a pair of replaceable units in the form of toner cartridge 100 and imaging unit 200, it will be appreciated that the replaceable unit(s) of the image forming device may employ any suitable configuration as desired. For example, in one embodiment, the main toner supply for the image forming device, the developer unit, and the cleaner unit are housed in one replaceable unit. In another embodiment, the main toner supply for the image forming device and the developer unit are provided in a first replaceable unit and the cleaner unit is provided in a second replaceable unit. Further, although the example image forming device 22 discussed above includes one toner cartridge and corresponding imaging unit, in the case of an image forming device configured to print in color, separate replaceable units may be used for each toner color needed. For example, in one embodiment, the image forming device includes four toner cartridges and four corresponding imaging units, each toner cartridge containing a particular toner color (e.g., black, cyan, yellow and magenta) and each imaging unit corresponding with one of the toner cartridges to permit color printing.

Figure 6:
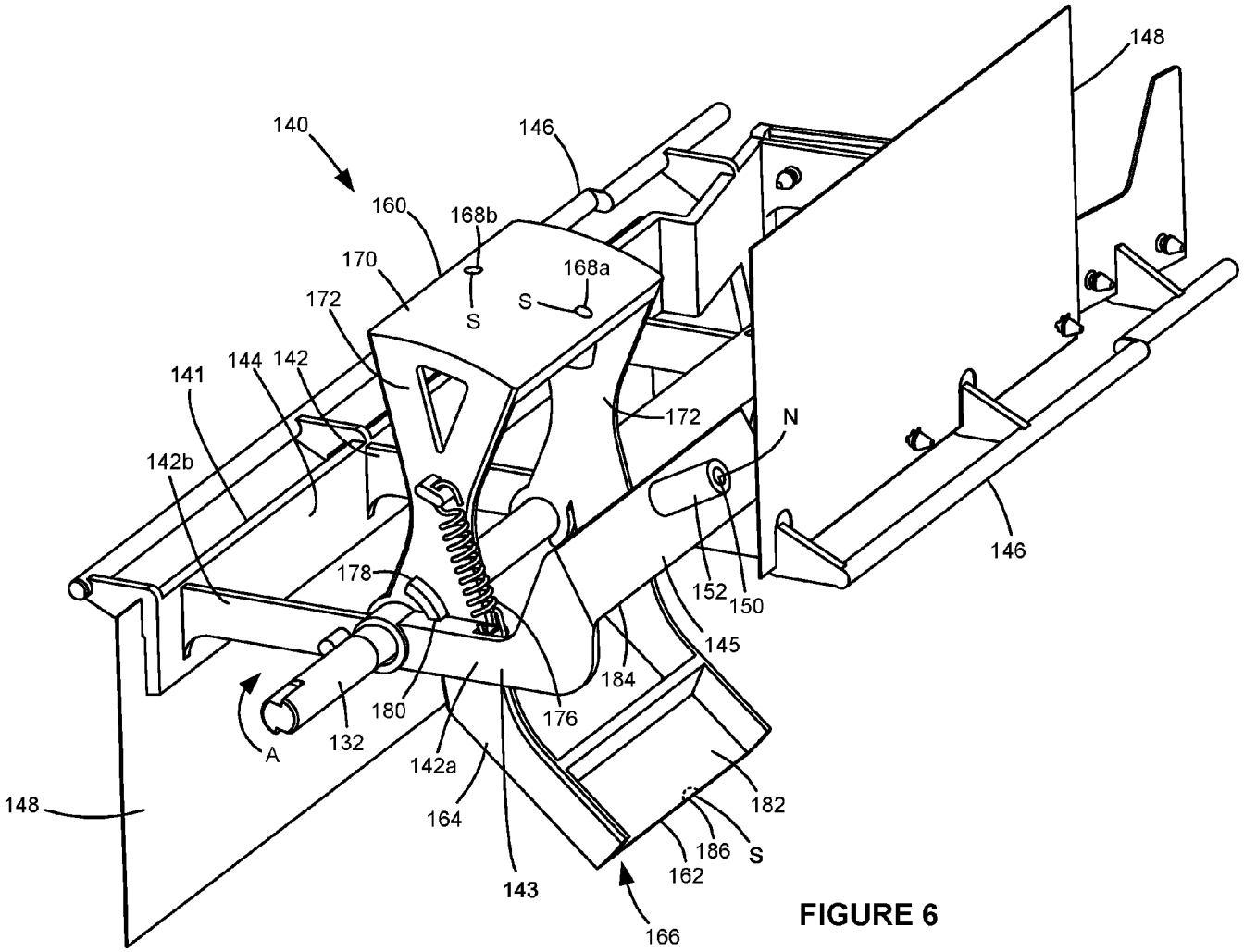
FIG. 6 is a perspective view of a paddle assembly of the toner cartridge according to one example embodiment.

FIG. 6 shows paddle assembly 140 in greater detail according to one example embodiment. In operation, shaft 132 rotates in the direction shown by arrow A in FIG. 6. Paddle assembly 140 includes a fixed paddle 141 that is fixed to shaft 132 such that fixed paddle 141 rotates with shaft 132. In one embodiment shaft 132 extends from side wall 110 to side wall 112. In the embodiment illustrated, fixed paddle 141 includes a plurality of arms 142 extending radially from shaft 132. In the example embodiment illustrated, fixed paddle 141 includes two sets 142*a*, 142*b* of arms 142. In this embodiment, in the position illustrated in FIG. 6, arms 142 of first set 142*a* extend from shaft 132 toward rear wall 116 and arms 142 of second set 142*b* extend from shaft 132 toward front wall 114. Of course these positions change as shaft 132 rotates. The arms 142 of each set 142*a*, 142*b* are radially aligned and axially offset from each other. The arms 142 of first set 142*a* are offset circumferentially by approximately 180 degrees from the arms 142 of second set 142*b*. Other embodiments include one set of arms 142 or more than two sets of arms 142 extending from shaft 132. In other embodiments, arms 142 are not arranged in sets. Further, arms 142 may extend radially or non-radially from shaft 132 in any manner desired.

Fixed paddle 141 may include a cross member 144 connected to each set 142*a*, 142*b* of arms 142. Cross members 144 may extend across all or a portion of the arms 142 of sets 142*a*, 142*b*. Cross members 144 help arms 142 stir and mix toner in reservoir 104 as shaft 132 rotates. A breaker bar 146 that is generally parallel to shaft 132 may be positioned radially outward from each cross member 144 and connected to the distal ends of arms 142. Breaker bars 146 are positioned in close proximity to inner surfaces of housing 102 without making contact with the inner surfaces of housing 102 to help break apart toner clumped near the inner surfaces of housing 102. Scrapers 148 may extend in a cantilevered manner from cross members 144. Scrapers 148 are formed from a flexible material such as a polyethylene terephthalate (PET) material, e.g., MYLAR® available from DuPont Teijin Films, Chester, Va., USA. Scrapers 148 form an interference fit with the inner surfaces of top 106, front wall 114, rear wall 116 and bottom 117 to wipe toner from the inner surfaces of reservoir 104. Scrapers 148 also push toner into open portion 138*a* of channel 138 as shaft 132 rotates. Specifically, as cross member 144 rotates past open portion 138*a* of channel 138, from bottom 117 to top 106, the interference fit between scraper 148 and the inner surface of front wall 114 causes scraper 148 to have an elastic response as the scraper 148 passes open portion 138*a* of channel 138 thereby flicking or pushing toner toward open portion 138*a* of channel 138. Additional scrapers may be provided on arms 142 at the axial ends of shaft 132 to wipe toner from the inner surfaces of side walls 110 and 112 as desired. The arrangement of fixed paddle 141 shown in FIG. 6 is not intended to be limiting. Fixed paddle 141 may include any suitable combination of projections, agitators, paddles, scrapers and linkages to agitate and move the toner stored in reservoir 104 as desired.

In the example embodiment illustrated, a permanent magnet 150 is rotatable with shaft 132 and detectable by a magnetic sensor as discussed in greater detail below. In one embodiment, magnet 150 is connected to shaft 132 by fixed paddle 141. In the example embodiment illustrated, first set 142*a* of arms 142 includes a pair of axially spaced arms 143 positioned at one axial end of shaft 132. Arms 143 initially extend radially outward from shaft 132 and then bend opposite the operative rotational direction of shaft 132 at the distal ends of arms 143. A cross member 145 connects the distal ends of arms 143 and extends substantially parallel to shaft 132. In the example embodiment shown, magnet 150 is positioned in a finger 152 that extends outward from cross member 145 toward the inner surfaces of housing 102. Finger 152 extends in close proximity to but does not contact the inner surfaces of housing 102 so that magnet 150 is positioned in close proximity to the inner surfaces of housing 102. In one embodiment, fixed paddle 141 is composed of a non-magnetic material and magnet 150 is held by a friction fit in a cavity in finger 152. Magnet 150 may also be attached to finger 152 using an adhesive or fastener(s) so long as magnet 150 will not dislodge from finger 152 during operation of toner cartridge 100. Magnet 150 may be any suitable size and shape so as to be detectable by a magnetic sensor. For example, magnet 150 may be a cube, a rectangular, octagonal or other form of prism, a sphere or cylinder, a thin sheet or an amorphous object. In another embodiment, finger 152 is composed of a magnetic material such that the body of finger 152 forms the magnet 150. Magnet 150 may be composed of any suitable material such as steel, iron, nickel, etc. While the example embodiment illustrated in FIG. 6 shows magnet 150 mounted on finger 152 of fixed paddle 141, magnet 150 may be positioned on any suitable linkage to shaft 132 such as a cross member, arm, projection, finger, agitator, paddle, etc. of fixed paddle 141 or separate from fixed paddle 141.

A sensing linkage 160 is mounted to shaft 132. Sensing linkage 160 rotates with shaft 132 but is movable to a certain degree independent of shaft 132. Sensing linkage 160 is free to rotate forward and backward on shaft 132 relative to fixed paddle 141 and to magnet 150 between a forward rotational stop and a rearward rotational stop. Sensing linkage 160 includes a leading paddle member 162. In the embodiment illustrated, leading paddle member 162 is connected to shaft 132 by a pair of arms 164 positioned between and next to arms 143 of fixed paddle 141. Leading paddle member 162 includes a paddle surface 166 that engages the toner in reservoir 104 as discussed in greater detail below. In the example embodiment illustrated, paddle surface 166 is substantially planar and normal to the direction of motion of sensing linkage 160 to allow paddle surface 166 to strike toner in reservoir 104.

Sensing linkage 160 also includes one or more permanent magnets 168. Magnet(s) 168 are mounted on one or more magnet support(s) 170 of sensing linkage 160 that are positioned in close proximity to but do not contact the inner surfaces of housing 102. In this manner, magnet(s) 168 are positioned in close proximity to the inner surfaces of housing 102 but the inner surfaces of housing 102 do not impede the motion of sensing linkage 160. In the example embodiment illustrated, magnet support 170 is connected to shaft 132 by a pair of arms 172 positioned between and next to arms 143 of fixed paddle 141. Arms 172 are connected to arms 164. In this embodiment, in the position illustrated in FIG. 6, arms 172 extend from shaft 132 toward top 106. Of course the position of arms 172 changes as shaft 132 rotates. In this embodiment, magnet support 170 is relatively thin in the radial dimension and extends circumferentially relative to shaft 132 between distal ends of arms 172 along the rotational path of magnet(s) 168 to minimize the drag on magnet support 170 as it passes through toner in reservoir 104. Along the operative rotational direction A of shaft 132, leading paddle member 162 is positioned ahead of magnet 150 (e.g., by less than 180 degrees) and magnet 150 is positioned ahead of magnet(s) 168 (e.g., by less than 180 degrees).

In the example embodiment illustrated, two magnets 168*a*, 168*b* are mounted on magnet support 170, however, one magnet 168 or more than two magnets 168 may be used as desired as discussed below. Magnets 168*a*, 168*b* are substantially radially and axially aligned and spaced circumferentially from each other relative to shaft 132. Magnet(s) 168 are also substantially radially and axially aligned and spaced circumferentially from magnet 150 relative to shaft 132. In one embodiment, magnet support 170 is composed of a non-magnetic material and magnet(s) 168 are held by a friction fit in one or more cavities in magnetic support 170. Magnet(s) 168 may also be attached to magnet support 170 using an adhesive or fastener(s) so long as magnet(s) 168 will not dislodge from magnet support 170 during operation of toner cartridge 100. As discussed above, magnet(s) 168 may be any suitable size and shape and composed of any suitable material. Magnet support 170 may take many different forms including an arm, projection, linkage, cross member, etc.

In some embodiments, sensing linkage 160 is biased in the operative rotational direction toward a forward rotational stop by one or more biasing members. In the example embodiment illustrated, sensing linkage 160 is biased by an extension spring 176 connected at one end to an arm 172 of magnet support 170 and at the other end to arm 143 of fixed paddle 141. However, any suitable biasing member may be used as desired. For example, in another embodiment, a torsion spring biases sensing linkage 160 in the operative rotational direction. In another embodiment, a compression spring is connected at one end to an arm 164 of leading paddle member 162 and at the other end to arm 143 of fixed paddle 141. In another embodiment, sensing linkage 160 is free to fall by gravity toward its forward rotational stop as sensing linkage 160 rotates past the uppermost point of its rotational path. In the example embodiment illustrated, the forward rotational stop includes a stop 178 that extends axially from the side of one or both of the arms 172 of magnet support 170. Stop 178 is arched and includes a leading surface 180 that contacts arm 143 of fixed paddle 141 to limit the motion of sensing linkage 160 relative to magnet 150 in the operative rotational direction. In the example embodiment illustrated, the rearward rotational stop includes a trailing portion 182 of leading paddle member 162. Trailing portion 182 of leading paddle member 162 contacts a leading portion 184 of cross member 145 to limit the motion of sensing linkage 160 relative to magnet 150 in a direction opposite the operative rotational direction. It will be appreciated that the forward and rearward rotational stops may take other forms as desired.

Figure 7A:
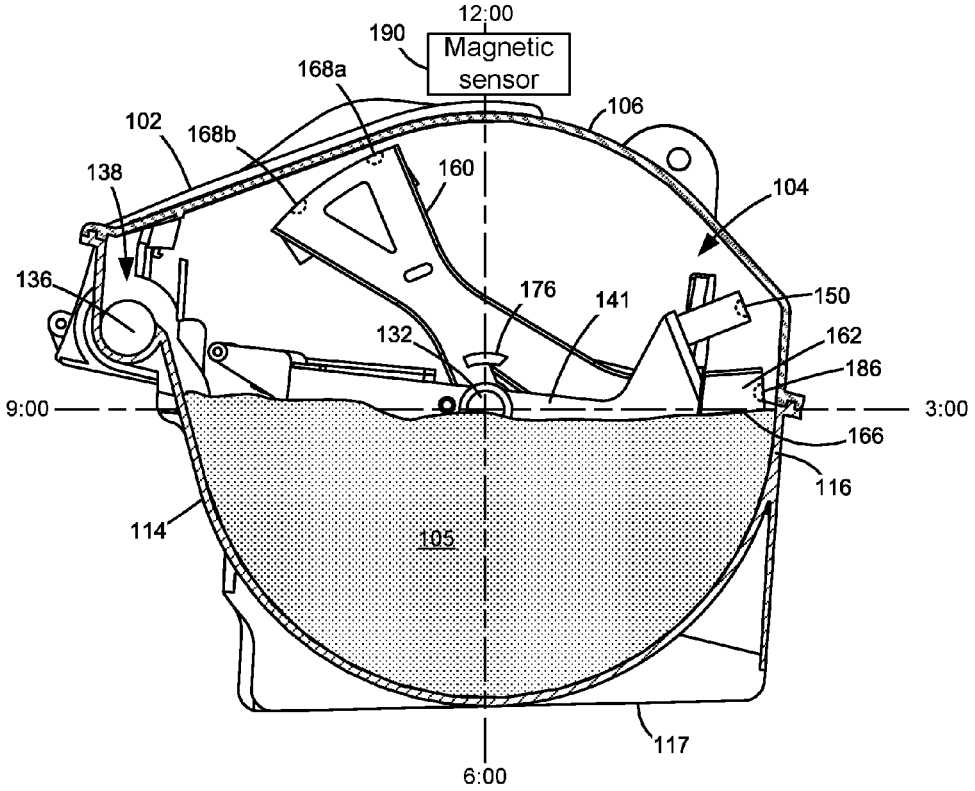
FIGS. 7A-C are cross-sectional side views of the toner cartridge illustrating the operation of a sensing linkage at various toner levels according to one example embodiment.
Figure 7B:
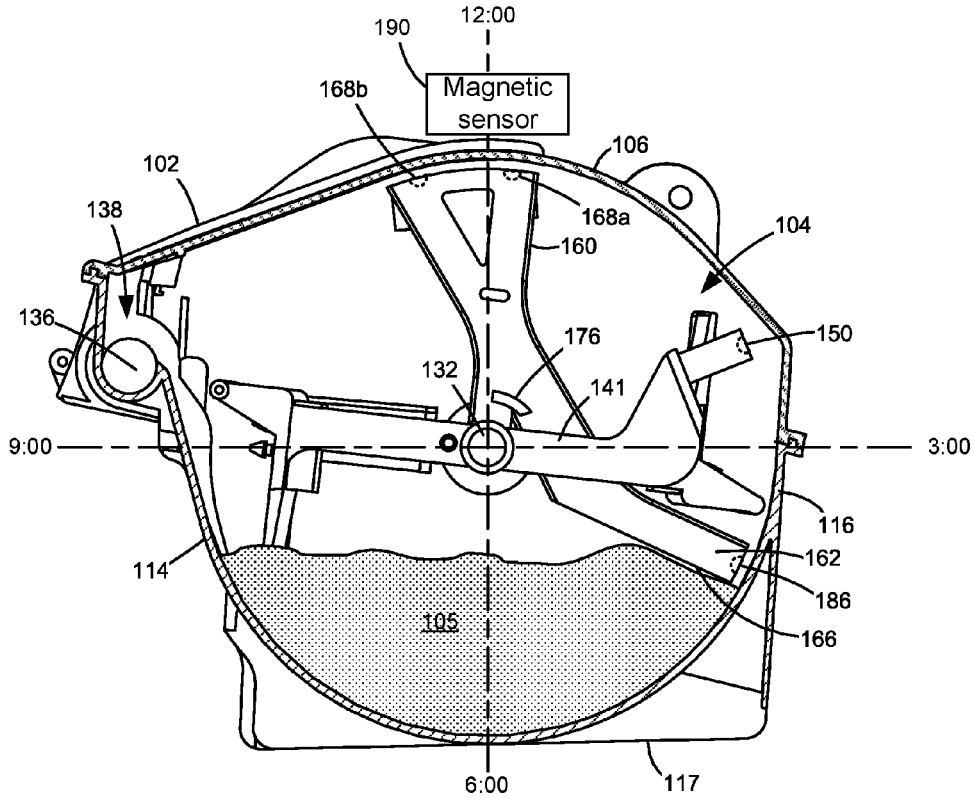
Figure 7C:
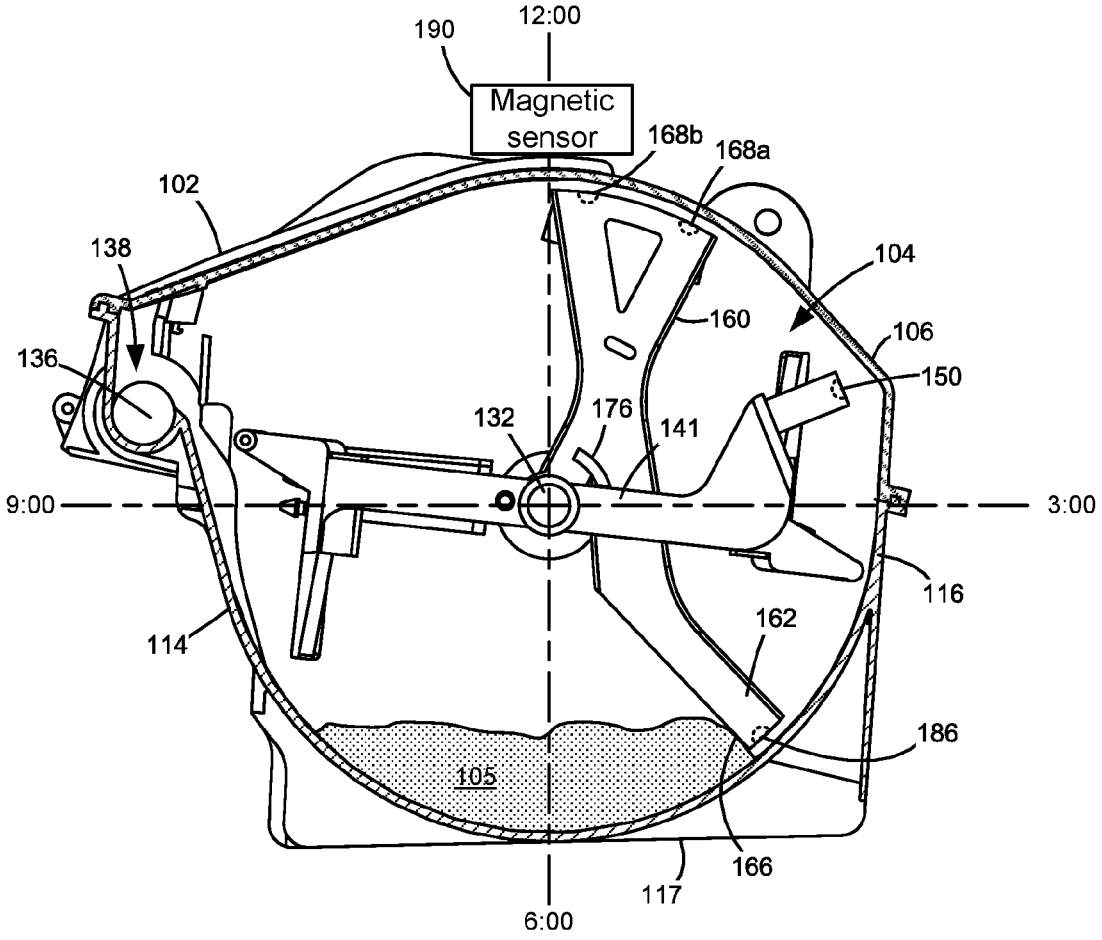

FIGS. 7A-7C depict the operation of magnets 150 and 168 at various toner levels. FIGS. 7A-7C depict a clock face in dashed lines along the rotational path of shaft 132 and paddle assembly 140 in order to aid in the description of the operation of magnets 150 and 168. A magnetic sensor 190 is positioned to detect the motion of magnets 150 and 168 during rotation of shaft 132 in order to determine the amount of toner remaining in reservoir 104 as discussed in greater detail below. In one embodiment, magnetic sensor 190 is mounted on housing 102 of toner cartridge 100. In this embodiment, magnetic sensor 190 is in electronic communication with processing circuitry 45 of toner cartridge 100 so that information from magnetic sensor 190 can be sent to controller 28 of image forming device 22. In another embodiment, magnetic sensor 190 is positioned on a portion of image forming device 22 adjacent to housing 102 when toner cartridge 100 is installed in image forming device 22. In this embodiment, magnetic sensor 190 is in electronic communication with controller 28. In the example embodiment illustrated, magnetic sensor 190 is positioned adjacent to or on top 106. In other embodiments, magnetic sensor 190 is positioned adjacent to or on bottom 117, front wall 114, rear wall 116 or side wall 110 or 112. In those embodiments where magnetic sensor 190 is positioned adjacent to or on top 106, bottom 117, front wall 114 or rear wall 116, magnets 150 and 168 are positioned adjacent to the inner surfaces of top 106, bottom 117, front wall 114 or rear wall 116 as shaft 132 rotates, such as at the radial ends of fixed paddle 141 and sensing linkage 160. In those embodiments where magnetic sensor 190 is positioned adjacent to or on side wall 110 or 112, magnets 150 and 168 are positioned adjacent to the inner surface of side wall 110 or 112, such as at the axial ends of fixed paddle 141 and sensing linkage 160. Magnetic sensor 190 may be any suitable device capable of detecting the presence or absence of a magnetic field. For example, magnetic sensor 190 may be a hall-effect sensor, which is a transducer that varies its electrical output in response to a magnetic field. In the example embodiment illustrated, magnetic sensor 190 is positioned outside of reservoir 104 at about the "12 o'clock" position relative to paddle assembly 140.

The motion of sensing linkage 160 and magnet(s) 168 relative to magnet 150 as shaft 132 rotates may be used to determine the amount of toner remaining in reservoir 104. As shaft 132 rotates, in the embodiment illustrated, fixed paddle 141 rotates with shaft 132 causing magnet 150 to pass magnetic sensor 190 at the same point during each revolution of shaft 132. On the other hand, the motion of sensing linkage 160, which is free to rotate relative to shaft 132 between its forward and rearward rotational stops, depends on the amount of toner 105 present in reservoir 104. As a result, magnet(s) 168 pass magnetic sensor 190 at different points during the revolution of shaft 132 depending on the toner level in reservoir 104. Accordingly, variation in the angular separation or offset between magnet 150, which serves as a reference point, and magnet(s) 168, which provide(s) sense points, as they pass magnetic sensor 190 may be used to determine the amount of toner remaining in reservoir 104. In an alternative embodiment, the linkage connecting magnet 150 to shaft 132, such as fixed paddle 141, is movable to a certain degree independent of shaft 132; however, it is preferred that magnet 150 passes magnetic sensor 190 in the same position relative to shaft 132 during each revolution of shaft 132 so that the position(s) of magnet(s) 168 may be consistently evaluated relative to the position of magnet 150.

When toner reservoir 104 is relatively full, toner 105 present in reservoir 104 prevents sensing linkage 160 from advancing ahead of its rearward rotational stop. Instead, sensing linkage 160 is pushed through its rotational path by fixed paddle 141 when shaft 132 rotates. Accordingly, when toner reservoir 104 is relatively full, the amount of rotation of shaft 132 between magnet 150 passing magnetic sensor 190 and magnets 168*a*, 168*b* on sensing linkage 160 passing magnetic sensor 190 is at its maximum. In other words, because sensing linkage 160 is at its rearward rotational stop, the angular separation from magnet 168*a* to magnet 150 when magnet 168*a* reaches magnetic sensor 190 and from magnet 168*b* to magnet 150 when magnet 168*b* reaches magnetic sensor 190 are at their maximum limits.

As the toner level in reservoir 104 decreases as shown in FIG. 7A, sensing linkage 160 is positioned forward from its rearward rotational stop as leading paddle member 162 rotates forward from the "12 o'clock" position. Leading paddle member 162 advances ahead of the rearward rotational stop of sensing linkage 160 until paddle surface 166 contacts toner 105, which stops the advance of sensing linkage 160. In one embodiment where paddle assembly 140 includes scrapers 148, scrapers 148 are not present on cross member 144 connected to set 142*b* of arms 142 along the axial portion of shaft 132 spanned by leading paddle member 162 so that toner 105 is not disturbed immediately before paddle surface 166 contacts toner 105 after leading paddle member 162 rotates forward from the "12 o'clock" position. At higher toner levels, leading paddle member 162 is stopped by toner 105 before magnets 168*a*, 168*b* reach magnetic sensor 190 such that the amount of rotation of shaft 132 between magnet 150 passing magnetic sensor 190 and magnets 168*a*, 168*b* passing magnetic sensor 190 remains at its maximum. Sensing linkage 160 then remains generally stationary on top of (or slightly below) toner 105 until fixed paddle 141 catches up to leading paddle member 162 at the rearward rotational stop of sensing linkage 160 and fixed paddle 141 resumes pushing sensing linkage 160.

With reference to FIG. 7B, as the toner level in reservoir 104 continues to decrease, at the point where leading paddle member 162 encounters toner 105 magnet 168*a* is detected by magnetic sensor 190. As a result, the amount of rotation of shaft 132 between magnet 150 passing magnetic sensor 190 and magnet 168*a* passing magnetic sensor 190 decreases. Sensing linkage 160 then remains generally stationary on top of (or slightly below) toner 105 with magnet 168*a* in the sensing window of magnetic sensor 190 until fixed paddle 141 catches up to leading paddle member 162 and resumes pushing sensing linkage 160. As a result, leading paddle member 162 is stopped by toner 105 before magnet 168*b* reaches magnetic sensor 190 such that the amount of rotation of shaft 132 between magnet 150 passing magnetic sensor 190 and magnet 168*b* passing magnetic sensor 190 remains at its maximum.

With reference to FIG. 7C, as the toner level in reservoir 104 decreases even further, at the point where leading paddle member 162 encounters toner 105 magnet 168*a* has passed magnetic sensor 190 and magnet 168*b* is detected by magnetic sensor 190. As a result, the amount of rotation of shaft 132 between magnet 150 passing magnetic sensor 190 and magnets 168*a* and 168*b* passing magnetic sensor 190 are both decreased relative to their maximums. As a result, it will be appreciated that the motion of magnets 168*a*, 168*b* relative to the motion of magnet 150 relates to the amount of toner 105 remaining in reservoir 104.

Figure 8:
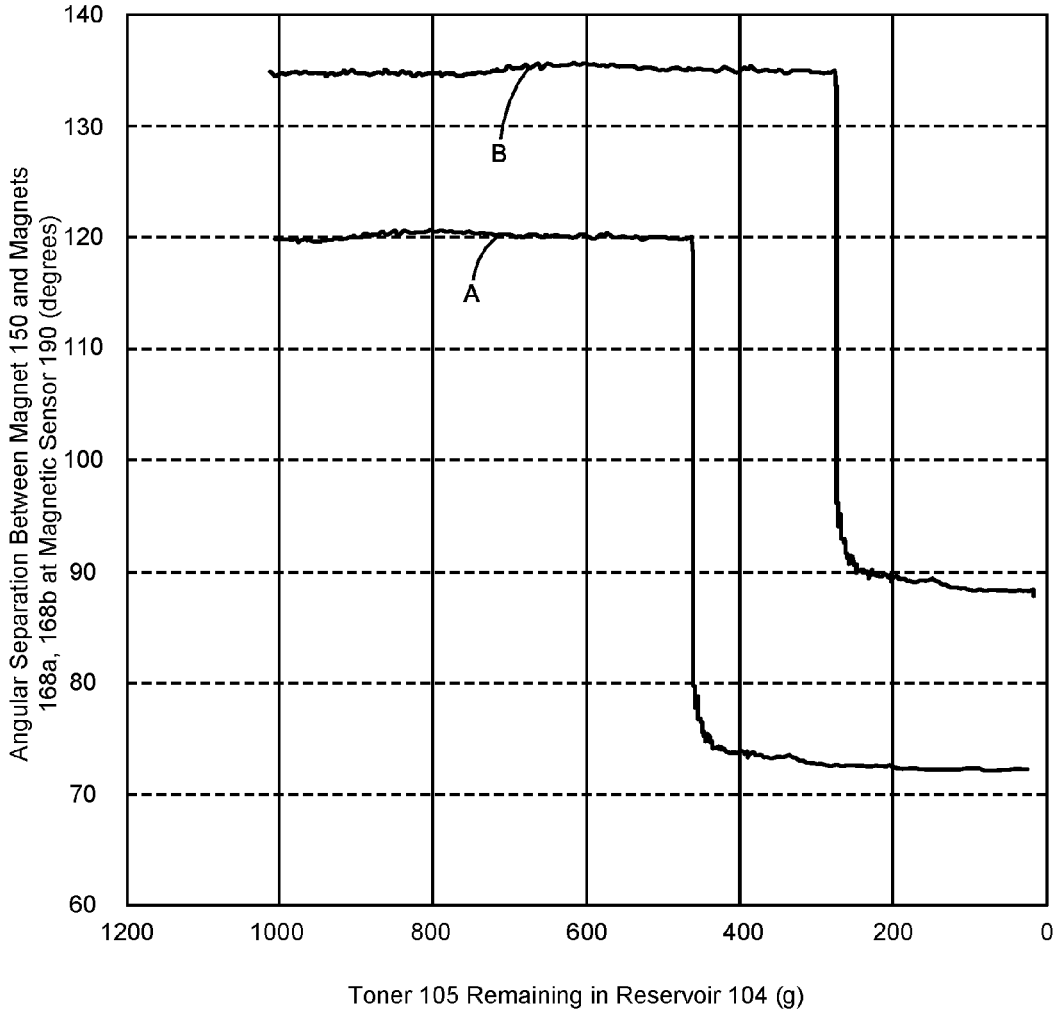
FIG. 8 is a graph of an angular separation between a reference magnet and sense magnets at the point where they pass a magnetic sensor versus an amount of toner remaining in the reservoir of the toner cartridge according to one example embodiment.

FIG. 8 is a graph of the angular separation between magnet 150 and magnets 168*a* and 168*b* at the point where they pass magnetic sensor 190 versus the amount of toner 105 remaining in reservoir 104 according to one example embodiment. Specifically, line A is the angular separation between magnet 150 and magnet 168*a* versus the amount of toner 105 remaining in reservoir 104 and line B is the angular separation between magnet 150 and magnet 168*b* versus the amount of toner 105 remaining in reservoir 104. As shown in FIG. 8, at higher toner levels, the amount of rotation of shaft 132 between magnet 150 passing magnetic sensor 190 and magnets 168*a*, 168*b* passing magnetic sensor 190 remains at its maximum. In this example, when about 450 grams of toner 105 remain in reservoir 104, leading paddle member 162 advances ahead of the rearward rotational stop of sensing linkage 160 until paddle surface 166 contacts toner 105 at a point where magnet 168*a* is in the sensing window of magnetic sensor 190. As a result, the amount of rotation of shaft 132 between magnet 150 passing magnetic sensor 190 and magnet 168*a* passing magnetic sensor 190 decreases while the amount of rotation of shaft 132 between magnet 150 passing magnetic sensor 190 and magnet 168*b* passing magnetic sensor 190 remains at its maximum. In this example, when about 300 grams of toner 105 remain in reservoir 104, leading paddle member 162 advances ahead of the rearward rotational stop of sensing linkage 160 until paddle surface 166 contacts toner 105 at a point where magnet 168*b* is in the sensing window of magnetic sensor 190. As a result, the amount of rotation of shaft 132 between magnet 150 passing magnetic sensor 190 and magnets 168*a* and 168*b* passing magnetic sensor 190 are both decreased relative to their maximums.

In some embodiments, a pole of each magnet 150, 168 is directed toward the position of magnetic sensor 190 in order to facilitate the detection of magnets 150, 168 by magnetic sensor 190. For example, where magnetic sensor 190 is positioned adjacent to or on top 106, a pole of each magnet 150, 168 is directed radially outward, away from shaft 132 and toward top 106, bottom 117, front wall 114 and rear wall 116 as shaft 132 rotates. Magnetic sensor 190 may be configured to detect one of a north pole and a south pole or both. Where magnetic sensor 190 detects one of a north pole and a south pole, magnets 150, 168 are positioned such that the detected pole is directed toward magnetic sensor 190.

Where magnetic sensor 190 is configured to detect both a north pole and a south pole, in some embodiments, a first pole of magnet 150 is directed toward magnetic sensor 190 and an opposite pole of magnet(s) 168 is directed toward magnetic sensor 190. For example, FIG. 6 shows a north pole of magnet 150 directed radially outward, away from shaft 132 and toward top 106, bottom 117, front wall 114 and rear wall 116 as shaft 132 rotates and south poles of magnets

168*a* and 168*b* directed radially outward, away from shaft 132 and toward top 106, bottom 117, front wall 114 and rear wall 116 as shaft 132 rotates. Directing opposite poles of magnet 150 and magnet(s) 168 toward magnetic sensor 190 allows controller 28 (or another processor) to immediately distinguish magnet 150 from magnet(s) 168 based on the polarity detected. Otherwise, where magnet 150 and magnet(s) 168 have the same orientation relative to magnetic sensor 190, the processor must infer whether a magnet detected by magnetic sensor 190 is magnet 150 or magnet(s) 168 by comparing the amount of rotation of shaft 132 that occurs between the detection of successive magnets with the known range of possible angular positions of magnet(s) 168 relative to magnet 150 (and the known angular separation between magnets 168*a*, 168*b*, etc. if more than one magnet 168 is present). The range of angular positions of magnet(s) 168 relative to magnet 150 is defined by the positions of the forward rotational stop and the rearward rotational stop of sensing linkage 160. Accordingly, where magnet 150 and magnet(s) 168 have the same orientation relative to magnetic sensor 190, the detection of at least two magnets is required before magnet 150 can be distinguished from magnet(s) 168.

Information from magnetic sensor 190 may be used by controller 28 or a processor in communication with controller 28, such as a processor of processing circuitry 45, to aid in determining the amount of toner 105 remaining in reservoir 104. In one embodiment, the initial amount of toner 105 in reservoir 104 is recorded in memory associated with processing circuitry 45 upon filling the toner cartridge 100. Accordingly, upon installing toner cartridge 100 in image forming device 22, the processor determining the amount of toner 105 remaining in reservoir 104 is able to determine the initial toner level in reservoir 104. Alternatively, each toner cartridge 100 for a particular type of image forming device 22 may be filled with the same amount of toner so that the initial toner level in reservoir 104 used by the processor may be a fixed value for all toner cartridges 100. The processor then estimates the amount of toner remaining in reservoir 104 as toner is fed from toner cartridge to imaging unit 200 based on one or more operating conditions of image forming device 22 and/or toner cartridge 100. In one embodiment, the amount of toner 105 remaining in reservoir 104 is approximated based on an empirically derived feed rate of toner 105 from toner reservoir 104 when shaft 132 and auger 136 are rotated to deliver toner from toner cartridge 100 to imaging unit 200. In this embodiment, the estimate of the amount of toner 105 remaining is decreased based on the amount of rotation of the drive motor of image forming device 22 that provides rotational force to main interface gear 130 as determined by controller 28. In another embodiment, the estimate of the amount of toner 105 remaining is decreased based on the number of printable elements (pels) printed using the color of toner contained in toner cartridge 100 while toner cartridge 100 is installed in image forming device 22. In another embodiment, the estimate of the amount of toner 105 remaining is decreased based on the number of pages printed.

The amount of toner 105 remaining in reservoir 104 where the amount of rotation of shaft 132 that occurs between magnet 150 passing magnetic sensor 190 and each of the magnets 168 passing magnetic sensor 190 decreases may be determined empirically for a particular toner cartridge design. As a result, each time the amount of rotation of shaft 132 between the detection of magnet 150 and the detection of one of the magnets 168 decreases from its maximum value, the processor may adjust the estimate of the amount of toner remaining in reservoir 104 based on the empirically determined amount of toner associated with the decrease in the amount of rotation of shaft 132 between magnet 150 passing magnetic sensor 190 and the respective magnet 168 passing magnetic sensor 190.

For example, the toner level in reservoir 104 can be approximated by starting with the initial amount of toner 105 supplied in reservoir 104 and reducing the estimate of the amount of toner 105 remaining in reservoir 104 as toner 105 from reservoir 104 is consumed. As discussed above, the estimate of the toner remaining may be decreased based on one or more conditions such as the number of rotations of the drive motor, main interface gear 130 or shaft 132, the number of pels printed, the number of pages printed, etc. The estimated amount of toner remaining may be recalculated when the amount of rotation of shaft 132 as determined by controller 28 between magnet 150 passing magnetic sensor 190 and magnet 168*a* of sensing linkage 160 passing magnetic sensor 190 decreases from its maximum value. In one embodiment, this includes replacing the estimate of the amount of toner remaining with the empirical value associated with the decrease in the amount of rotation of shaft 132 between magnet 150 passing magnetic sensor 190 and magnet 168*a* passing magnetic sensor 190. In another embodiment, the recalculation gives weight to both the present estimate of the amount of toner remaining and the empirical value associated with the decrease in the amount of rotation of shaft 132 between magnet 150 passing magnetic sensor 190 and magnet 168*a* passing magnetic sensor 190. The revised estimate of the amount of toner 105 remaining in reservoir 104 is then decreased as toner 105 from reservoir 104 is consumed using one or more conditions as discussed above. The estimated amount of toner remaining may be recalculated again when the amount of rotation of shaft 132 as determined by controller 28 between magnet 150 passing magnetic sensor 190 and magnet 168*b* of sensing linkage 160 passing magnetic sensor 190 decreases from its maximum value. As discussed above, this may include replacing the estimate of the amount of toner remaining or recalculating the estimate giving weight to both the present estimate of the amount of toner remaining and the empirical value associated with the decrease in the amount of rotation of shaft 132 between magnet 150 passing magnetic sensor 190 and magnet 168*b* passing magnetic sensor 190. This process may be repeated until reservoir 104 is out of toner 105. In one embodiment, the present estimate of the amount of toner 105 remaining in reservoir 104 is stored in memory associated with processing circuitry 45 of toner cartridge 100 so that the estimate travels with toner cartridge 100 in case toner cartridge 100 is removed from one image forming device 22 and installed in another image forming device 22.

In this manner, the detection of the motion of magnets 168 relative to the motion of magnet 150 may serve as a correction for an estimate of the toner level in reservoir 104 based on other conditions such as an empirically derived feed rate of toner or the number of pels or pages printed as discussed above to account for variability and to correct potential error in such an estimate. For example, an estimate of the toner level based on conditions such as an empirically derived feed rate of toner or the number of pels or pages printed may drift from the actual amount of toner 105 remaining in reservoir 104 over the life of toner cartridge 100, i.e., a difference between an estimate of the toner level and the actual toner level may tend to increase over the life of toner cartridge 100. Recalculating the estimate of the amount of toner 105 remaining based on the motion of magnet(s) 168 relative to the motion of magnet 150 helps correct this drift to provide a more accurate estimate of the amount of toner 105 remaining in reservoir 104.

It will be appreciated that sensing linkage 160 may include any suitable number of magnets 168 desired depending on how many recalculations of the estimate of the amount of toner remaining are desired. For example, sensing linkage 160 may include more than two magnets 168 spaced circumferentially from each other where recalculation of the estimated toner level is desired more frequently. Alternatively, sensing linkage 160 may include a single magnet 168 where recalculation of the estimated toner level is desired only once, such as near the point where reservoir 104 is nearly empty. The positions of magnets 168 relative to leading paddle member 162 may be selected in order to sense particular toner levels desired (e.g., 300 grams of toner remaining, 100 grams of toner remaining, etc.). Further, where shaft 132 rotates at a constant speed during operation of toner cartridge 100, time differences between the detection of magnet 150 and magnet(s) 168 by magnetic sensor 190 may be used instead of the amount of rotation of shaft 132. In this embodiment, time differences greater than a predetermined threshold between the detection of magnet 150 and one or more of magnet(s) 168 may be ignored by the processor to account for shaft 132 stopping between print jobs.

Figure 9A:
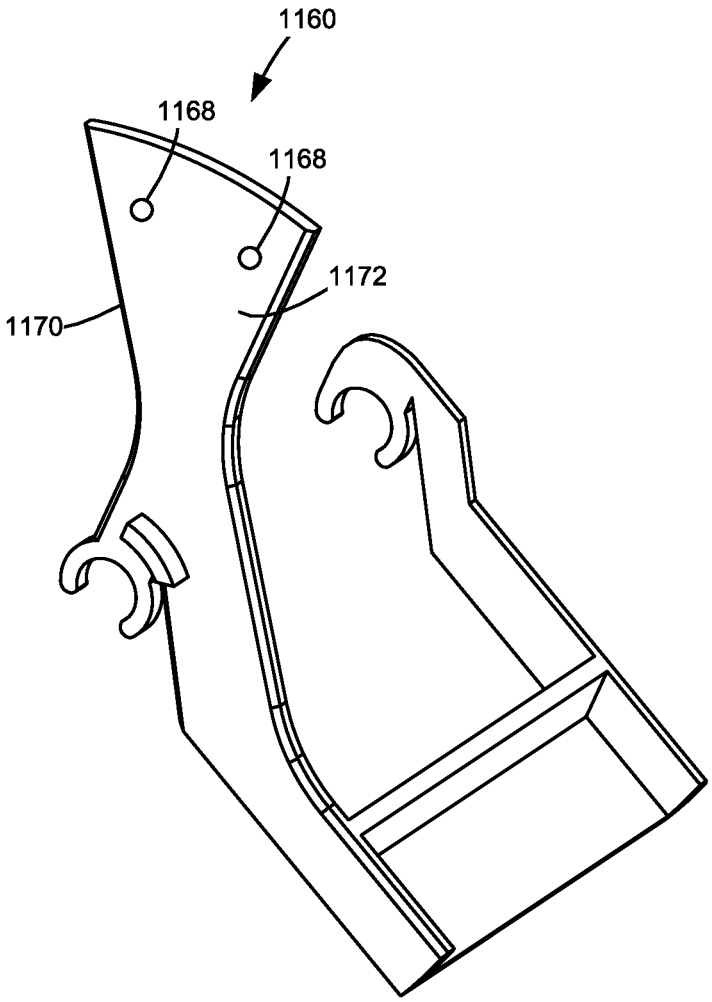
FIG. 9A is a perspective view of a sensing linkage according to a second example embodiment.
Figure 9B:
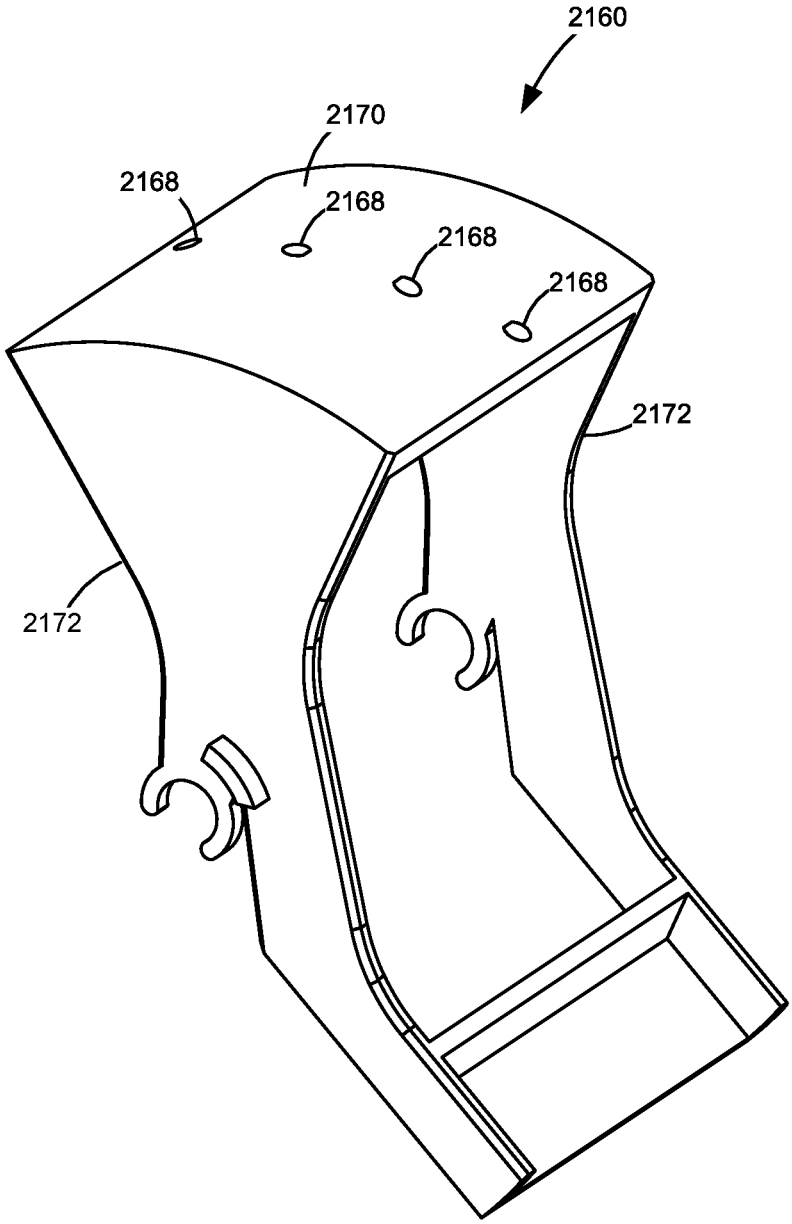
FIG. 9B is a perspective view of a sensing linkage according to a third example embodiment.
Figure 9C:
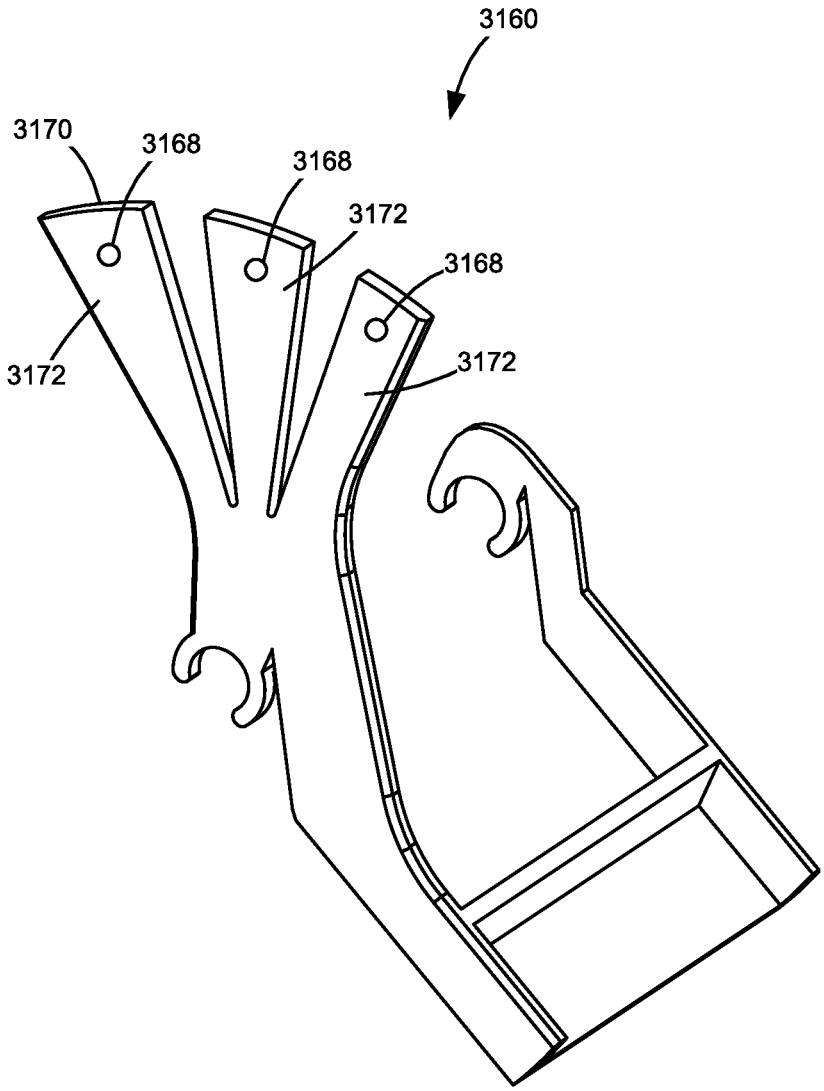
FIG. 9C is a perspective view of a sensing linkage according to a fourth example embodiment.

Sensing linkage 160 is not limited to the shape and architecture shown in FIG. 6 and may take many shapes and sizes as desired. For example, FIG. 9A illustrates a sensing linkage 1160 that includes a magnet support 1170 that extends radially in the form of an arm 1172. Magnet support 1170 is relatively thin in the axial direction and includes magnets 1168 that are aligned radially and axially and spaced circumferentially from each other. In this embodiment, magnets 1168 are positioned at an axial end of sensing linkage 1160 in position to be detected by a magnetic sensor adjacent to or on side wall 110 or 112. FIG. 9B illustrates a sensing linkage 2160 that, like sensing linkage 160 discussed above with respect to FIG. 6, includes a pair of arms 2172 that connect a magnet support 2170 to shaft 132. Sensing linkage 2160 differs from sensing linkage 160 in that magnet support 2170 and arms 2172 extend further in the circumferential dimension to accommodate additional magnets 2168. FIG. 9C illustrates a sensing linkage 3160 that includes a series of circumferentially spaced and axially aligned radial arms 3172 that each serve as a magnet support 3170. In this embodiment, each magnet support 3170 positions a respective magnet 3168 for detection by a magnetic sensor positioned adjacent to or on side wall 110 or 112.

The leading paddle member 162 having paddle surface 166 that engages the toner in reservoir 104 may also take many shapes and sizes as desired. For example, in one embodiment, paddle surface 166 is angled with respect to the direction of motion of the sensing linkage 160. For example, paddle surface 166 may be V-shaped and have a front face that forms a concave portion of the V-shaped profile. In another embodiment, paddle surface 166 includes a comb portion with a series of teeth that are spaced axially from each other to decrease the friction between the sensing linkage and the toner. The surface area of paddle surface 166 may also vary as desired. Further, in some embodiments, leading paddle member 162 includes a permanent magnet 186 that is positioned for detection by magnetic sensor 190 as shown in FIG. 6. Variation in the angular separation or offset between magnet 150 and magnet 186 as they pass magnetic sensor 190 may be used to further detect the motion of sensing linkage 160 relative to magnet 150 to estimate the amount of toner remaining in reservoir 104. In those embodiments where the poles of magnet 150 are oriented opposite the poles of magnet(s) 168, the poles of magnet 186 may have the same orientation as magnet(s) 168. For example, FIG. 6 shows a south pole of magnet 186 directed radially outward, away from shaft 132, like magnets 168*a*, 168*b*.

Accordingly, an amount of toner remaining in a reservoir may be determined by sensing the relative motion between a sensing linkage and a fixed linkage within the reservoir. Because the motion of the sensing linkage and the fixed linkage are detectable by a sensor outside of reservoir 104, the sensing linkage and the fixed linkage may be provided without an electrical or mechanical connection to the outside of housing 102 (other than shaft 132). This avoids the need to seal an additional connection into reservoir 104, which could be susceptible to leakage. Positioning magnetic sensor 190 outside of reservoir 104 reduces the risk of toner contamination, which could damage the sensor. Magnetic sensor 190 may also be used to detect the installation of toner cartridge 100 in the image forming device and to confirm that shaft 132 is rotating properly thereby eliminating the need for additional sensors to perform these functions.

While the example embodiments illustrated in FIG. 7A-7C show magnetic sensor 190 positioned at about "12 o'clock" with respect to paddle assembly 140, magnetic sensor 190 may be positioned elsewhere in the rotational path of paddle assembly 140 as desired. For example, magnetic sensor 190 may be positioned at about "6 o'clock" with respect to paddle assembly 140 by changing the positions of magnet 150 and magnet(s) 168 relative to leading paddle member 162 by 180 degrees.

Although the example embodiments discussed above utilize a sensing linkage and a fixed linkage in the reservoir of the toner cartridge, it will be appreciated that a sensing linkage and a fixed linkage each having a magnet may be used to determine the toner level in any reservoir or sump storing toner in image forming device 22 such as, for example, a reservoir of the imaging unit or a storage area for waste toner. Further, although the example embodiments discussed above discuss a system for determining a toner level, it will be appreciated that this system and the methods discussed herein may be used to determine the level of a particulate material other than toner such as, for example, grain, seed, flour, sugar, salt, etc.

While the examples discuss sensing magnets using a magnetic sensor, in another embodiment, an inductive sensor, such as an eddy current sensor, or a capacitive sensor is used instead of a magnetic sensor. In this embodiment, the fixed linkage and the sensing linkage include electrically conductive elements detectable by the inductive or capacitive sensor. As discussed above with respect to magnets 150 and 168, the metallic elements may be attached to the fixed linkage and the sensing linkage by a friction fit, adhesive, fastener(s), etc. or a portion of the fixed linkage and the sensing linkage may be composed of a metallic material.

Figure 10:
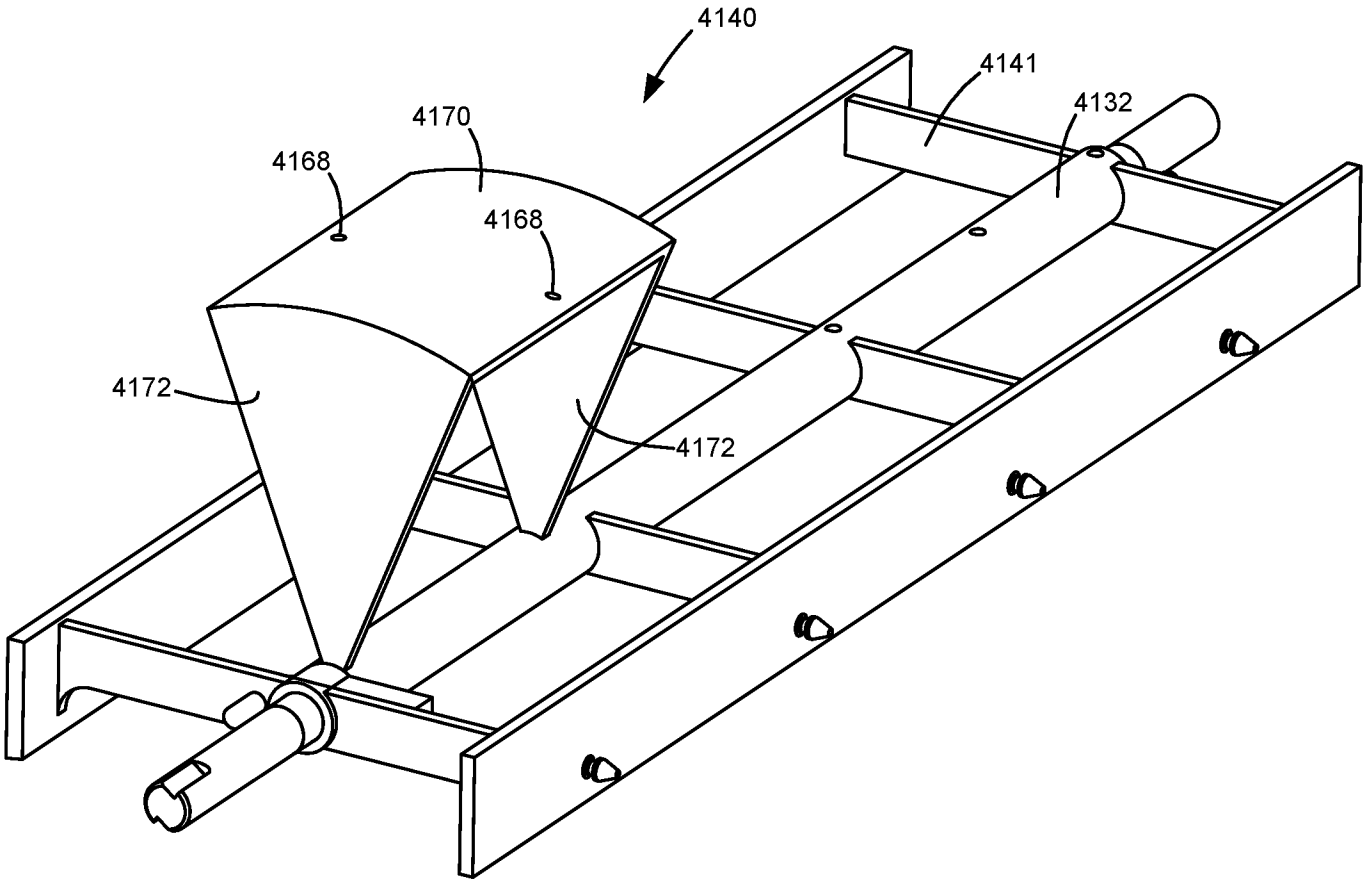
FIG. 10 is a perspective view of a paddle assembly of the toner cartridge according to another example embodiment.

FIG. 10 shows another example embodiment of a paddle assembly 4140. In this embodiment, the toner cartridge includes a paddle 4141 that is fixed to a shaft 4132 such that paddle 4141 rotates with shaft 4132. Paddle 4141 includes a plurality of permanent magnets 4168 mounted on one or more magnet support(s) 4170. Magnets 4168 are positioned in close proximity to but do not contact the inner surfaces of the housing of the toner cartridge as discussed above. In the example embodiment illustrated, magnet support 4170 is connected to shaft 4132 by a pair of arms 4172. In the example embodiment illustrated, two magnets 4168*a*, 4168*b* are mounted on magnet support 4170; however, more than two magnets 4168 may be used as desired. Magnets 4168*a*, 4168*b* are substantially radially and axially aligned and spaced circumferentially from each other relative to shaft 4132. Magnets 4168 may be oriented, shaped and mounted to shaft 4132 in various ways as discussed above. In this embodiment, magnetic sensor 190 detects magnets 4168 as shaft rotates 4132. In this manner, magnetic sensor 190 may be used to detect the presence of the toner cartridge in the image forming device and to confirm that shaft 4132 is rotating properly thereby eliminating the need for additional sensors to perform these functions. Magnetic sensor 190 may also be used to determine the speed of rotation of shaft 4132 by measuring the time difference between the detection of magnet 4168*a* and the detection of magnet 4168*b* as shaft 4132 rotates. Magnetic sensor 190 may also be used to determine the amount of rotation of shaft 4132 by counting the passes of magnets 4168.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A replaceable unit for an electrophotographic image forming device, comprising:

a housing having a reservoir for storing toner;

a rotatable shaft positioned within the reservoir and having an axis of rotation;

a first linkage rotatable with the rotatable shaft, the first linkage having a first permanent magnet; and a second linkage rotatable in response to rotation of the rotatable shaft, the second linkage having a second permanent magnet, the second linkage is rotatable independent of the rotatable shaft between a forward rotational stop and a rearward rotational stop such that an amount of angular offset between the first permanent magnet and the second permanent magnet varies depending on a rotational position of the second linkage relative to the forward rotational stop and the rearward rotational stop, wherein a polarity of the first permanent magnet is oriented opposite a polarity of the second permanent magnet relative to the rotatable shaft.

2. The replaceable unit of claim 1, wherein one of a north pole and a south pole of the first permanent magnet is directed radially outward away from the rotatable shaft and the other of a north pole and a south pole of the second permanent magnet is directed radially outward away from the rotatable shaft.

3. The replaceable unit of claim 1, wherein the first permanent magnet is substantially axially aligned with the second permanent magnet with respect to the axis of rotation.

4. The replaceable unit of claim 1, wherein the first permanent magnet is substantially radially aligned with the second permanent magnet with respect to the axis of rotation.

5. The replaceable unit of claim 1, wherein the second linkage has a paddle member leading the first permanent magnet in an operative rotational direction of the rotatable shaft and the second permanent magnet trails the first permanent magnet in the operative rotational direction of the rotatable shaft.

6. The replaceable unit of claim 5, wherein the paddle member includes a third permanent magnet.

7. The replaceable unit of claim 1, wherein the second linkage is biased by a biasing member in an operative rotational direction of the rotatable shaft toward the forward rotational stop.

8. A replaceable unit for an electrophotographic image forming device, comprising:

a housing having a reservoir for storing toner;

a rotatable shaft positioned within the reservoir and having an axis of rotation;

a first linkage rotatable with the rotatable shaft, the first linkage having a first permanent magnet; and a second linkage rotatable in response to rotation of the rotatable shaft, the second linkage having a second permanent magnet, the second linkage is rotatable independent of the rotatable shaft between a forward rotational stop and a rearward rotational stop such that an amount of angular offset between the first permanent magnet and the second permanent magnet varies depending on a rotational position of the second linkage relative to the forward rotational stop and the rearward rotational stop, wherein the first permanent magnet and the second permanent magnet pass near at least a portion of an inner wall of the housing forming the reservoir during rotation of the first and second linkages, a first pole of the first permanent magnet is directed radially outward away from the rotatable shaft and a second pole of the second permanent magnet is directed radially outward away from the rotatable shaft, a polarity of the first pole is opposite a polarity of the second pole.

9. The replaceable unit of claim 8, wherein the first permanent magnet is substantially axially aligned with the second permanent magnet with respect to the axis of rotation.

10. The replaceable unit of claim 8, wherein the first permanent magnet is substantially radially aligned with the second permanent magnet with respect to the axis of rotation.

11. The replaceable unit of claim 8, wherein the second linkage has a paddle member leading the first permanent magnet in an operative rotational direction of the rotatable shaft and the second permanent magnet trails the first permanent magnet in the operative rotational direction of the rotatable shaft.

12. The replaceable unit of claim 11, wherein the paddle member includes a third permanent magnet that passes near at least a portion of the inner wall of the housing forming the reservoir during rotation of the rotatable shaft.

13. The replaceable unit of claim 8, wherein the second linkage is biased by a biasing member in an operative rotational direction of the rotatable shaft toward the forward rotational stop.

14. A replaceable unit for an electrophotographic image forming device, comprising:

a housing having a reservoir for storing toner;

a rotatable shaft positioned within the reservoir and having an axis of rotation;

a first linkage rotatable with the rotatable shaft, the first linkage having a first permanent magnet; and a second linkage rotatable in response to rotation of the rotatable shaft, the second linkage having a second permanent magnet and a third permanent magnet, the third permanent magnet leads the first permanent magnet in an operative rotational direction of the rotatable shaft and the second permanent magnet trails the first permanent magnet in the operative rotational direction of the rotatable shaft, the second linkage is rotatable independent of the rotatable shaft between a forward rotational stop and a rearward rotational stop such that an amount of angular offset between the first permanent magnet and the second permanent magnet and an amount of angular offset between the first permanent magnet and the third permanent magnet vary depending on a rotational position of the second linkage relative to the forward rotational stop and the rearward rotational stop.

15. The replaceable unit of claim 14, wherein the first permanent magnet, the second permanent magnet and the third permanent magnet are substantially axially aligned with respect to the axis of rotation.

16. The replaceable unit of claim 14, wherein the first permanent magnet, the second permanent magnet and the third permanent magnet are substantially radially aligned with respect to the axis of rotation.

17. The replaceable unit of claim 14, wherein the second linkage has a paddle member leading the first permanent magnet in the operative rotational direction of the rotatable shaft and the third permanent magnet is mounted on the paddle member.

18. The replaceable unit of claim 14, wherein the second linkage is biased by a biasing member in the operative rotational direction of the rotatable shaft toward the forward rotational stop.

* * * * *